United States Patent [19]

Svensson et al.

[11] Patent Number: 4,659,547

[45] Date of Patent: Apr. 21, 1987

[54] INHOMOGENEOUS SINTERED BODY

[75] Inventors: Lars-Erik Svensson; Ove Thornblad, both of Höganäs, Sweden

[73] Assignee: Höganäs AB, Höganäs, Sweden

[21] Appl. No.: 829,127

[22] PCT Filed: May 23, 1985

[86] PCT No.: PCT/SE85/00217

§ 371 Date: Jan. 8, 1986

§ 102(e) Date: Jan. 8, 1986

[87] PCT Pub. No.: WO85/05352

PCT Pub. Date: Dec. 5, 1985

[30] Foreign Application Priority Data

May 24, 1984 [SE] Sweden ..... 8402811

[51] Int. Cl.[4] ..... B22F 7/00

[52] U.S. Cl. ..... 419/6; 75/231; 75/235; 75/236; 75/243; 264/60; 264/65; 264/125; 419/10; 419/17; 419/19; 419/23; 419/36; 419/37; 419/39; 419/56; 428/552; 428/564

[58] Field of Search ..... 419/6, 23, 36, 37, 10, 419/14, 39, 17, 56, 19; 264/125, 65, 60; 428/552, 564; 75/231, 235, 236, 243

[56] References Cited

U.S. PATENT DOCUMENTS

| | | | |
|---|---|---|---|
| 3,953,177 | 4/1976 | Sedlatschek et al. | 428/539.5 |
| 4,102,679 | 7/1978 | Arvela | 419/52 |
| 4,500,364 | 2/1985 | Krutenat | 419/19 |
| 4,569,692 | 2/1986 | Butt | 75/230 |
| 4,569,693 | 2/1986 | Albrecht et al. | 419/19 |

FOREIGN PATENT DOCUMENTS

| | | |
|---|---|---|
| 3026696 | 2/1982 | Fed. Rep. of Germany . |
| 00844 | 3/1983 | PCT Int'l Appl. . |
| 02483 | 7/1984 | PCT Int'l Appl. . |
| 315742 | 10/1969 | Sweden . |
| 338439 | 9/1971 | Sweden . |
| 1339742 | 12/1973 | United Kingdom . |

*Primary Examiner*—Stephen J. Lechert, Jr.
*Attorney, Agent, or Firm*—Burns, Doane, Swecker & Mathis

[57] ABSTRACT

The invention resides in a process of preparing an inhomogeneous sintered body by adjoining metal powder with refractory ceramic powder at normal powder metallurgical pressures and sintering conditions. The invention is characterized thereby that the sintered body is manufactured in one layer or several layers having displaced mixing ratio between the ceramics and the metal and that the binding between ceramics and metal is strengthened with monoaluminium phosphate or a monoaluminium phosphate former. The sintered body can be used for example as heat shielding.

20 Claims, 2 Drawing Figures

α %
1,0
0,80
0,60
0,40
0,20
0
Mixture C
Mixture B
Mixture A
0
100
200
300
400
500
600
Temperature °C α %
1,0
0,80
0,60
0,40
0,20
0
Testbody of mixture C
Testbody IV
Testbody III
Testbody of mixture A
0
100
200
300
400
500
600
Temperature °C

INHOMOGENEOUS SINTERED BODY

The object of the invention is to prepare components using a powder-metallurgic manufacturing technique and starting from metal powder and refractory ceramic powder with high requirements as to the binding between the components involved.

The powder-metallurgic manufacturing technique is characterized by production in long series of parts having high dimensional accuracy. The chain of manufactures starts by mixing a metallic powder, for example iron powder, optionally having added pulverulent alloying agents thereto with a lubricant to facilitate the subsequent compacting operation. In this operation the powder mixture is compacted to a moulding blank the shape of which closely or completely corresponds to the shape of the final part. The blank is heated and is then maintained at a temperature at which it by sintering obtains its final properties, such as strength, toughness etc.

Serial manufacture of dry-compacted refractory ceramics shows several similarities with the powder-metallurgic manufacturing technique. In iron powder based manufacture sintering normally takes place within the temperature range 1000°–1300° C. For more low-melting metals and alloys, such as for example aluminium and bronze, the sintering temperature usually lies between 500°–900° C. When manufacturing powder-compacted refractory ceramics the sintering, however, takes place within the temperature range 1400°–1700° C.

Refractory materials are in combination with metals, for example as heat shielding, of quite a great interest. The difficulty of adjoining the refractory material with the metal in a durable manner lies in the fact that the materials involved normally have different coefficients of expansion. Joining may then be accomplished using for example countersunk bolts which, however, when used under mechanical load i.a. can result in unsuitably high weight to obtain the necessary strength. It is also possible to perform joining using a glue, but then it is a requirement that heating cannot take place beyond the heat resistance of the glue. If inorganic glue, for example water-glass, is used in such cases when the ceramics is expected to be subjected to a relatively high temperature there is an obvious risk that different coefficients of expansion will cause failure of the ceramics. Moreover, the multitude of operational steps in this manufacture results in high costs. Other known methods are for example soldering on ceramics. This is a laborious method requiring high accuracy and at least seven different operational steps. Moreover, it is required that the grain size of the soldering powder shall be less than 1 micron.

According to the invention it has, however, been found that it is possible by powder-pressing and subsequent sintering to obtain in a simple manner suprisingly good binding between ceramics and metal. The simplicity consists i.a. in the fact that it has been found possible in one step to press together the ceramic powder and the metal powder (for example iron powder). The pressing can take place at such low pressures as about 0.5 ton/cm$^2$, and high strength can be obtained also in the ceramic part at such low temperature as 800° C.

There are two partly overlapping problems which the inventors have been obliged to solve. The dilatation curves for metals and ceramics usually differ strongly from each other. It has been found that the damaging effect of this can be eliminated by using as a binding phase between a ceramic layer and a metal layer one or several layers of a mixture of the components involved. The fraction of metal or ceramics to be present in the mixture as wholly dependant on the area of use and whether the mixture shall be bound to ceramics and/or metal. It is obvious that sintered bodies also can be manufactured in accordance with the invention in only one layer and where the amount of the components involved can be controlled by the area of use. At the temperature which can be endured by the metal part of the sintered body the refractory ceramics sinters only poorly. It has, however, been found possible to modify the ceramic material involved in such a manner that the necessary strength will be obtained during sintering. This can be achieved in two ways, namely either by adding alumina or aluminum hydrate and phosphoric acid or dry phosphoric acid and a suitable quantity of water, or by adding monoaluminium phosphate solution or monoaluminium phosphate and water, such added material forming an effective binder between metal and ceramics.

In the following the invention will be exemplified and experiments will be presented which have been made using the technique according to the invention and the unexpected results hereby obtained.

EXAMPLE 1

Figure 1:
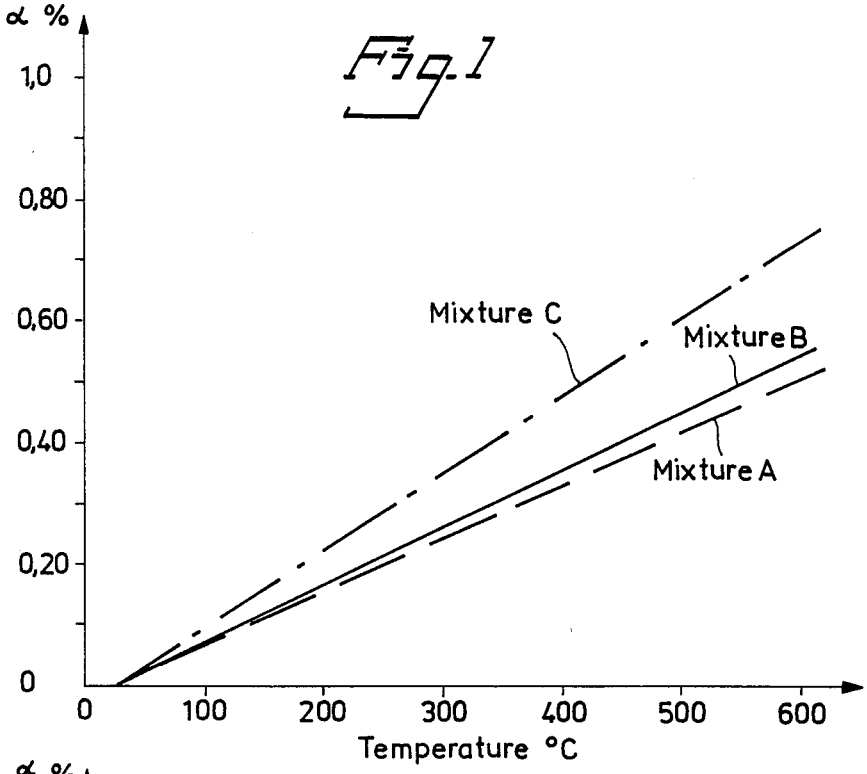
FIG. 1 is a graph depicting the dilatation curves for test bodies prepared from mixtures A–C in Example 1 within the temperature range 20°–600° C.
Figure 2:
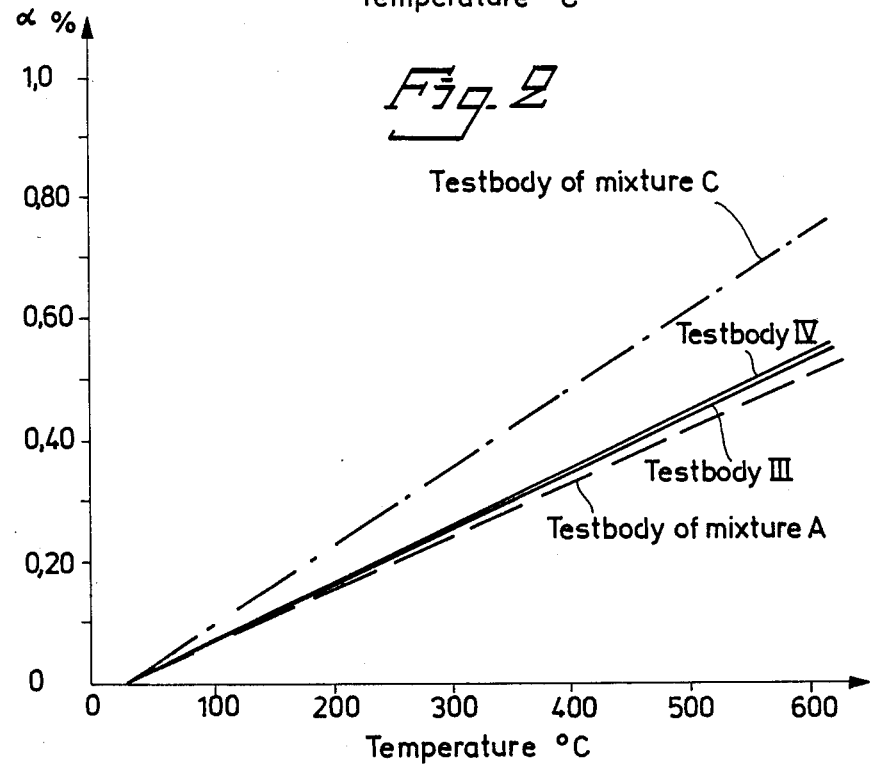
FIG. 2 is a graph depicting the dilatation curves for multi-layered bodies prepared according to the invention and for pressed and sintered ceramics within the temperature range 20°–600° C.

A mixture, designated A, was prepared in the following manner. 600 g of alumina powder having a maximum particle size of 400 microns and 350 g alumina powder having a maximum particle size of 45 microns were thouroughly mixed together with 50 g of 80% phosphoric acid.

500 g of the mixture prepared according to the above was admixed with 500 g of ironsponge powder having a maximum particle size of 147 microns. The mixture thus prepared is in the following designated B.

A mixture C consisting of the following components was prepared: 990 g of ironsponge powder having a maximum particle size of 147 microns, 10 g of zinc stearate powder having a maximum particle size of 147 microns.

Of each of mixtures A–C there were prepared test bodies having the dimensions $\phi$ 25 mm, h 25 mm, by pressing at a pressure of 200 MPa, heat treatment in evaporation oven at 300° C. for a period of time of 15 min. in a neutral atmosphere, and the bodies were then sintered at a temperature of 1050° C. for 30 min. in a non-oxidizing atmosphere.

The dilatation process was determined for the test bodies thus prepared within the temperature range 20°–600° C. The result which is presented in diagram 1 surprisingly shows that the dilatation process for the test body manufactured from mixture B corresponded considerably closer to the dilatation process registered for the test body manufactured from mixture A than to the process for the test body from mixture C in spite of the fact that mixture B is constituted by the same parts by weight of mixture A and C.

EXAMPLE 2

Four powder mixtures, D, E, F and G having a composition according to the table below were prepared:

Mixture D:

90% alumina powder having a maximum particle size of 150 microns 5.0 monoaluminum phosphate solution 5.0 carbon-forming organic powder.

Mixture E:

50.0% of mixture D.

50.0% of an ironsponge powder having a maximum particle size of 210 microns.

Mixture F:

95.0% alumina powder having a maximum particle size of 150 microns.

5.0% carbon-forming organic powder.

Mixture G:

50.0% of mixture F.

50.0% of an ironsponge powder having a maximum particle size of 210 microns.

Testbodies having the dimensions $\phi$ 25 mm and h 25 mm were pressed in two layers at a pressure of 90 MPa. The composition of the testbodies is clear from the table below.

Testbody I:

Layer 1: consisting of powder from mixture D.

Layer 2: consisting of powder from mixture E.

Testbody II:

Layer 1: consisting of powder from mixture F.

Layer 2: consisting of powder from mixture G.

The testbodies were sintered at 900° C. for 20 min. in a neutral protective gas atmosphere.

The testbodies thus prepared were investigated with regard to compressive strength. For testbody II there was measured a total load at break of 190N, whereas testbody I was still coherent at a load of 5500N, the investigation being discontinued. Moreover, the testbodies were examined under microscope making it clear that the significantly better strength measured for testbody I is a result of the fact that the addition of monoaluminum phosphate provides for sintering bonds between the ceramics particles but also, which is a wholly surprising effect, provides for sintering bonds between the ceramic particles and the metal particles. The results of the experiments described herein show that the binding between ceramics and metal can be considerably improved by using the process according to the invention.

EXAMPLE 3

Multi-layer testbodies having the composition according to the table below were prepared.

Testbody III:

Layer 1: consisting of 92.0% alumina powder and 8.0% dry phosphoric acid + a suitable quantity of water for forming monoaluminum phosphate.

Layer 2: consisting of 46.0% of alumina powder and 4.0% of dry phosphoric acid + water according to the above and 50.0% iron powder having a maximum particle size of 400 microns.

Layer 3: consisting of 96.0% of iron powder having a maximum particle size of 400 microns and 3.5% carbon-forming organic powder having a particle size of less than 400 microns and 0.5% of zinc stearate powder.

Testbody IV:

Layer 1: consisting of 95,0% alumina powder and 5.0% monoaluminum phosphate solution.

Layer 2: consisting of 71.0% alumina powder and 5.0% monoaluminum phosphate solution and 24.0% of iron powder.

Layer 3: consisting of 70.0% of iron powder and 25.0% of alumina powder and 5.0% of monoaluminum phosphate solution.

Layer 4: consisting of 99.3% of iron powder and 0.7% of zinc stearate powder.

The testbodies were pressed at 500 MPa, heat treated in evaporation oven and sintered at 1120° C. for 30 min. in protective gas atmosphere. The dilatation curves of the testbodies were measured. The result which is presented in diagram 2 shows that the dilatation process for multi-layered bodies prepared according to the invention corresponds very closely to the dilatation process for pressed and sintered ceramics.

Moreover, the testbodies were examined under microscope and it could be observed that good binding between ceramics and metal was obtained and creation of cracks between ceramic particles and metal particles could not be observed.

As a preliminary test for endurance to heat chock the testbodies were heated with a welding torch on the metal layer to glowing red and were then quenched in water. The test was repeated until all testbodies had disintegrated. None of the testbodies showed increased tendency for formation of cracks at the layer boundaries.

In the examples presented herein for the purpose of exemplifying the invention the inventors have used alumina and iron powder. However, experiments have shown that the ceramics may equally well be aluminum silicates, magnesium-aluminum silicates, zirconias, zirconium silicates, ortho silicates, silicon carbides and slags. Nor is the invention limited to iron powder and alloys thereof but also other metals, such as aluminum, copper, nickel, chromium, molybdenium, manganese and alloys thereof can be used.

It has also been found in continued experiments that it is possible for certain applications to use as a binder also other acid phosphate salts of 2- or 3-valent metals.

The wording used in claim 1: "or in several layers having different mixing ratios between the ceramics and metal used" is intended to cover also a composite body wherein the said ratio varies continuously over a cross-section of the body, for example from one side of it to the other. In other words, this embodiment is constituted by infinitesimally thin layers. In an extreme case the body may thus on one side thereof consist of metal whereas the opposite side consists of ceramics.

With regard to the binder used the presence of water is important. Thus at least one of the components of the binder may be added in the form of a solution. In the alternative dry material may be supplemented with external water. The amount of binder (based on solids thereof) is not particularly critical, but is suitably up to about 10% by weight, based on the weight of the composite body.

The lower limit is determined by the quantity necessary for effective binding. An amount of about 1% is usually necessary, and at least about 2 or 3% by weight is usually employed.

What is claimed is:

1. A process for preparing an inhomogeneous sintered body by adjoining metal powder with refractory ceramic powder at normal powder metallurgical pressures and sintering conditions, characterized thereby that the sintered body is manufactured in one layer, or in several layers having different mixing rations between the ceramics and metal used, and that in the ceramics part and in the mixing zone there is admixed monoaluminum phosphate or alumina (or aluminum hydrate) and phosphoric acid (or dry phosphoric acid).

2. A process according to claim 1, characterized thereby that sintering takes place at a temperature of 800°-1350° C., preferably 1000°-1250° C.

3. A process according to claim 1 or 2, characterized thereby that the powder pressing takes place at a pressure of 0.5-10 t/cm$^2$, preferably 1-5 t/cm$^2$.

4. A process according to claim 1, characterized thereby that sintering takes place for a period of at least 10 min. in a non-oxidizing atmosphere.

5. A process according to any of claim 1, characterized thereby that the metal powder contains one or several of the elements iron, aluminum, copper, nickel, molybdenium, chromium and manganese.

6. A process according to claim 1, characterized thereby that the metal powder additionally contains one or several of the elements carbon, phosphorus and silicon.

7. A process according to claim 1, characterized thereby that the ceramics contains one or several of the following ceramic materials: aluminum silicates, magnesium-aluminum silicates, zirconias, zirconium silicates, ortho silicates, silicon carbides and slags.

8. A process according to claim 2, characterized thereby that the powder pressing takes place at a pressure of 0.5-10 t/cm$^2$, preferably 1-5 t/cm$^2$.

9. A process according to claim 2, characterized thereby that sintering takes place for a period of at least 10 min. in a non-oxidizing atmosphere.

10. A process according to claim 3, characterized thereby that sintering takes place for a period of at least 10 min. in a non-oxidizing atmosphere.

11. A process according to claim 2, characterized thereby that the metal powder contains one or several of the elements iron, aluminum, copper, nickel, molybdenium, chromium and manganese.

12. A process according to claim 3, characterized thereby that the metal powder contains one or several of the elements iron, aluminum, copper, nickel, molybdenium, chromium and manganese.

13. A process according to claim 4, characterized thereby that the metal powder contains one or several of the elements iron, aluminum, copper, nickel, molybdenium, chromium and manganese.

14. A process according to claim 2, characterized thereby that the metal powder additionally contains one or several of the elements carbon, phosphorus and silicon.

15. A process according to claim 3, characterized thereby that the metal powder additionally contains one or several of the elements carbon, phosphorus and silicon.

16. A process according to claim 4, characterized thereby that the metal powder additionally contains one or several of the elements carbon, phosphorus and silicon.

17. A process according to claim 5, characterized thereby that the metal powder additionally contains one or several of the elements carbon, phosphorus and silicon.

18. A process according to claim 2, characterized thereby that the ceramics contains one or several of the following ceramic materials: aluminum silicates, magnesium-aluminum silicates, zirconias, zirconium silicates, ortho silicates, silicon carbides and slags.

19. A process according to claim 3, characterized thereby that the ceramics contains one or several of the following ceramic materials: aluminum silicates, magnesium-aluminum silicates, zirconias, zirconium silicates, ortho silicates, silicon carbides and slags.

20. A process according to claim 4, characterized thereby that the ceramics contains one or several of the following ceramic materials: aluminum silicates, magnesium-aluminum silicates, zirconias, zirconium silicates, ortho silicates, silicon carbides and slags.

* * * * *